US007117878B2

(12) United States Patent
Frei

(10) Patent No.: US 7,117,878 B2
(45) Date of Patent: Oct. 10, 2006

(54) METHOD AND DEVICE FOR PRODUCING TURBULENCES AND THE DISTRIBUTION THEREOF

(75) Inventor: Alexandra Sarah Frei, Winterthur (CH)

(73) Assignee: Lindenport S.A., Collex (CH)

( * ) Notice: Subject to any disclaimer, the term of this patent is extended or adjusted under 35 U.S.C. 154(b) by 290 days.

(21) Appl. No.: 10/483,547

(22) PCT Filed: Jul. 10, 2002

(86) PCT No.: PCT/CH02/00376

§ 371 (c)(1),
(2), (4) Date: Jan. 9, 2004

(87) PCT Pub. No.: WO03/008118
PCT Pub. Date: Jan. 30, 2003

(65) Prior Publication Data

US 2004/0182426 A1 Sep. 23, 2004

(30) Foreign Application Priority Data

Jul. 19, 2001 (CH) ..... 1340/01

(51) Int. Cl.
*B08B 9/093* (2006.01)
*B01F 5/04* (2006.01)

(52) U.S. Cl. ..... 134/22.18; 134/167 R; 366/173.2

(58) Field of Classification Search ..... 134/22.1, 134/22.18, 167 R, 168 R, 169 R; 366/173.2
See application file for complete search history.

(56) References Cited

U.S. PATENT DOCUMENTS 1,978,015 A 10/1934 Erdman
2,574,958 A 11/1951 Carr
3,586,294 A 6/1971 Strong
4,642,138 A * 2/1987 Koyase et al. ..... 134/22.18
6,041,793 A * 3/2000 Miyasaki ..... 134/22.1
6,217,207 B1 * 4/2001 Streich et al. ..... 366/137

FOREIGN PATENT DOCUMENTS

FR 2 766 469 1/1999
FR 2 771 654 6/1999
WO WO-97/41976 * 11/1997

OTHER PUBLICATIONS

WO 97/41976, Method and Device for Liquefying Thickened Crude Oil Sediments, Publication Date: Nov. 13, 1997.

* cited by examiner

*Primary Examiner*—Michael Barr
*Assistant Examiner*—Saeed Chaudhry
(74) *Attorney, Agent, or Firm*—Rankin, Hill, Porter & Clark LLP

(57) ABSTRACT

Each immersed jet creates turbulences as a result of the resistance of the medium in which it is immersed and at the end of its effective range the complete introduced energy is broken down into turbulent flows. These turbulent flows observed as a whole are local, thus are small-scale. However, these small-scale turbulences which have a strong eroding effect. The present invention produces as high a number as possible of small-scale turbulences and distributes them over a large volume. Large volume is to be understood as, for example, 3000–4000 $m^3$ on a surface of 2000 $m^2$ and a height of 2 m as is the case with a storage tank of 50 m diameter and a liquid column of 3 m. The problem thus lies in the optimal distribution of the introduced or applied energy.

16 Claims, 5 Drawing Sheets

METHOD AND DEVICE FOR PRODUCING TURBULENCES AND THE DISTRIBUTION THEREOF

BACKGROUND OF THE INVENTION

1. Field of the Invention

The invention lies in the field of the cleaning of crude oil tanks and is concerned with a method and a device for the recovery of thickened, sedimented crude oil by way of liquefaction of the sediment with non-sedimented crude oil. The method is furthermore suitable for mixing processes in fluids, for example in large to very large chemical reactors.

2. Description of Related Art

In the field of the cleaning of crude oil tanks there are known various methods with which, by way of introducing crude oil which is located above the sediment and/or is freshly supplied, the sediment is successively suspended and is partly dissolved in the crude oil. Two groups of methods are at the forefront: method 1 which with rotating nozzles whirls up and suspends the sediment, for example disclosed in EP 160 050, and method 2 which with stationary nozzles cooperating as a group erode the sediment, whirl it up and suspend it, for example disclosed in EP 912 262.

SUMMARY OF THE INVENTION

The invention relates to the method EP 0 912 262 mentioned under group 2. In this method, by way of a multitude of nozzles one forces a main flow direction, which has the task of releasing and suspending the sediment in an eroding manner. Auxiliary arranged nozzles, which are not orientated in the main flow direction, affect additional shear surfaces by way of which the turbulence may be increased further. The invention also relates to the use of the method in chemical reactors, in large tanks and wherever large volumes need to be intimately mixed.

Each immersed jet, due to the resistance in the medium in which it is immersed, produces turbulences and at the end of its range all the introduced energy is broken up into movement and turbulent flows. These turbulent flows, from the point of view of a large volume, are local and thus, small-scale. It is, however, true that these small-scale turbulences have a strong eroding effect and it is the object of the invention to produce as high a number of small-scale turbulences as possible and to distribute these over a large volume. Large volumes are to be understood as ones for example of 8000 $m^3$ on a surface of 2000 $m^2$ and a height of 4 m, such as is the case with a storage tank of 50 m diameter and a fluid column of 3–4 m. Such volumes may also be weakly "decoupled" in part volumes via shear surfaces. The problem thus lies in the optimal distribution of the introduced energy over a desired volume.

The hydrokinetic energy to be consumed for such large volumes lies in the order of several thousand horsepower. Roughly 30% is consumed by the pumps up to the nozzles. The rest, for example 2000 horsepower, is introduced into the medium via the nozzles. In the example, which is yet to be discussed, more than 3000 nozzles are aligned to one another such that there arises a maximum of turbulence. The main flow functions as a transport mechanism for local turbulences, which are thus distributed over the volume. The effect is a flowing swirling bed of high turbulence, thus chaos directed in a targeted manner.

The subsequently cited figures underscore the discussion of one embodiment example of the method in two variations.

Furthermore, a few embodiment examples of the device used for the method are shown.

DETAILED DESCRIPTION OF THE PREFERRED EMBODIMENTS

As already mentioned, it is primarily the case of the production of a multitude of local turbulences and of distributing these over a desired volume. An immersed jet is dependent on the pressure and on the through-flow quantity. Thus, in water, for example, at a pressure behind the nozzles of approx. 2 bar and a nozzle cross section of approx. 200 $mm^2$, a jet between 5–7 m is formed. The same is the case with a nozzle of 110 $mm^2$. If one arranges the nozzle with the larger through-flow quantity in a first plane into a main flow direction to be achieved, for example 90 nozzles, and a further number of nozzles with a smaller through-flow quantity in a second plane, for example 180 nozzles additionally at an angle of, for example 120°, counter to the main flow direction, as is shown in FIG. 1, and one directs a further 90 nozzles with any through-flow quantity in a third plane downwards transverse to the main flow direction, then firstly turbulences are formed locally in the field of influence of the nozzles, which are then transported away in the direction of the main flow.

Figure 1:
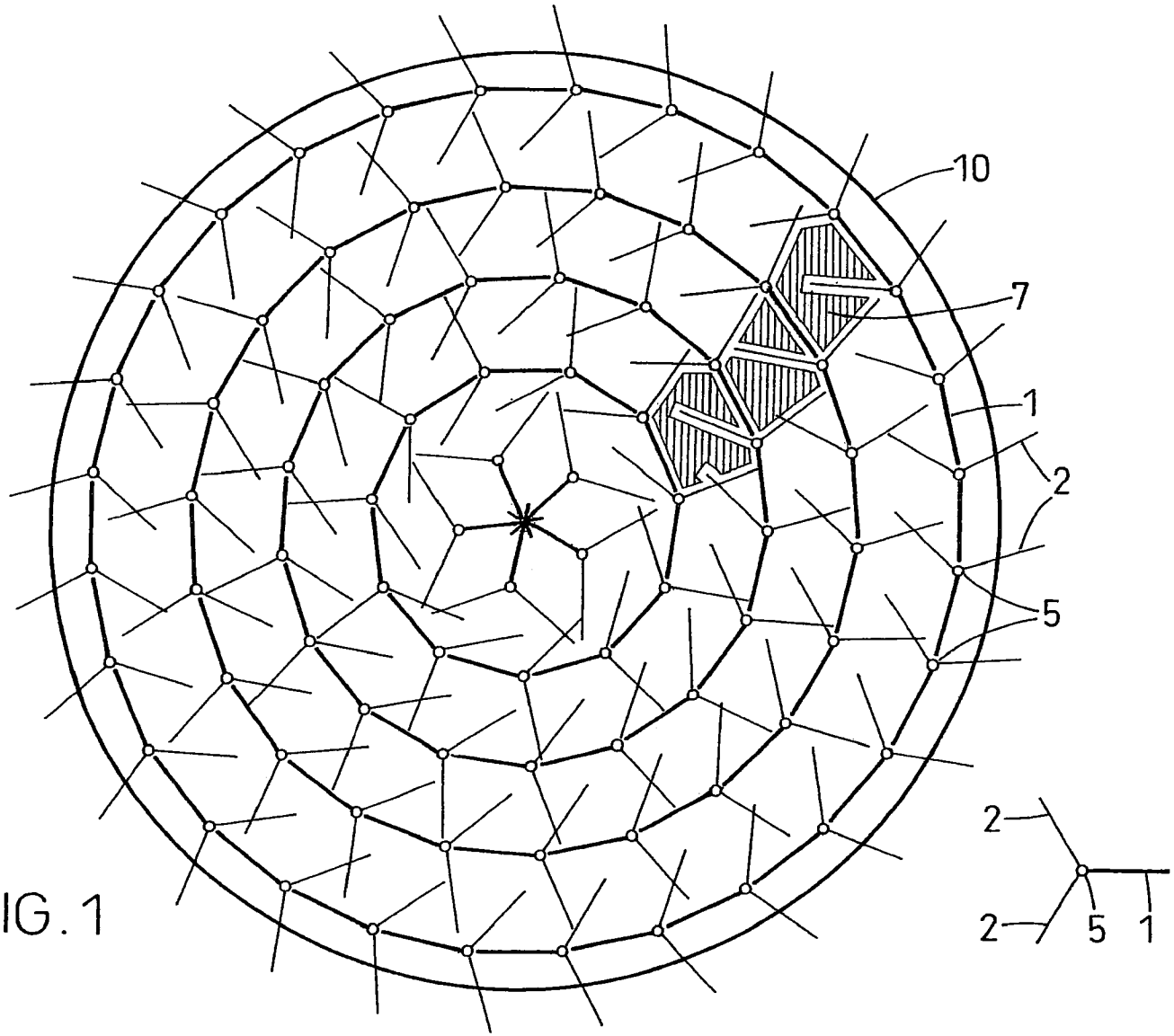
FIG. 1 schematically shows a first arrangement for achieving a flowing field of turbulence.

FIG. 1 viewed from above onto a container shows an example of an assembly of a multitude of lances 5 arranged annularly in the container 10 of which each comprises 4 nozzles, specifically: 1 nozzle for the jet 1 with 200 $mm^2$ in the main flow direction whose jet is drawn with a bold dash; 2 nozzles for the jet 2 with 110 $mm^2$ at a 120 degree angle in its own plane obliquely to the rear whose jets 2 are drawn in as a thin dash; 1 nozzle for the jet 3 perpendicular to the plane of the paper which in the medium points in the z direction, here downwards, is not visible. The jets drawn out of the vessel edge 10 in operation of course hit the wall of the vessel and are reflected in a turbulent manner. In the figure the approximate length of the jets is essentially represented, in practise they may be 5–7 meters long. Next to the vessel in the figure there is shown a single lance 5 with three jets: 1 main jet and 2 auxiliary jets for an improved overview. In a later figure it is discussed how it is physically constructed.

In order to achieve a main flow direction, as for example is shown here the lances are aligned such that the nozzle with the larger through-flow quantity points to the next lance, but all in the same orientation. Only the lances in the innermost circle are directed opposite one another in order to prevent a motionless zone in the eye of the flow. Since the radii of the circles become smaller from circle to circle the direction changes from the outside to the inside (but not the orientation). The figure then shows a well-covered field of immersed jets, wherein the main direction jet reaches downstream roughly to the next lance. The figure however also shows three hatched areas, which are to represent all intermediate spaces between the jets. These areas represent a type of "backwater", thus somewhat quiet zones which measure roughly 9–15 $m^2$. Over the whole area or over the whole volume this is roughly 80–90% of the volume that is not directly subjected to the turbulence. With a system with which the turbulences are not distributed an equilibrium would set in, thus a pattern of turbulent and non-turbulent zones. One then speaks of a static chaos. The flow that runs by way of the method according to the invention prevents such patterns. It carries the turbulences into the mentioned spaces or zones and past these beyond the next turbulence sources downstream into the next spaces until, with regard to these enormous volumes, there no longer exist any turbulent free space after a very short time. The directed transport of the turbulences is thus an essential procedure in order to permit the method to take its course in the specified enormous volumes in process times that are of commercial interest.

The method displays an extraordinary rapidity. Within a short period of time one succeeds in introducing a large quantity of energy into the fluid volume. For example in recirculation within 24–30 hours one may introduce the energy quantity of 2000 horsepower hours (1472 kWh) into 7–10'000 tons of fluid, wherein it heats up after 20 to 30 hours. Such procedures of intimate thorough mixing are also desired in chemical processing technology, wherein one may lead off undesired heat by way of cooling. Larger chemical reactors may be operated with the help of this method with a very high thorough mixing effect, wherein the device which is yet to be discussed is moreover very easy to clean and in its handling is well adapted to the field of chemical processing technology.

Figure 2:
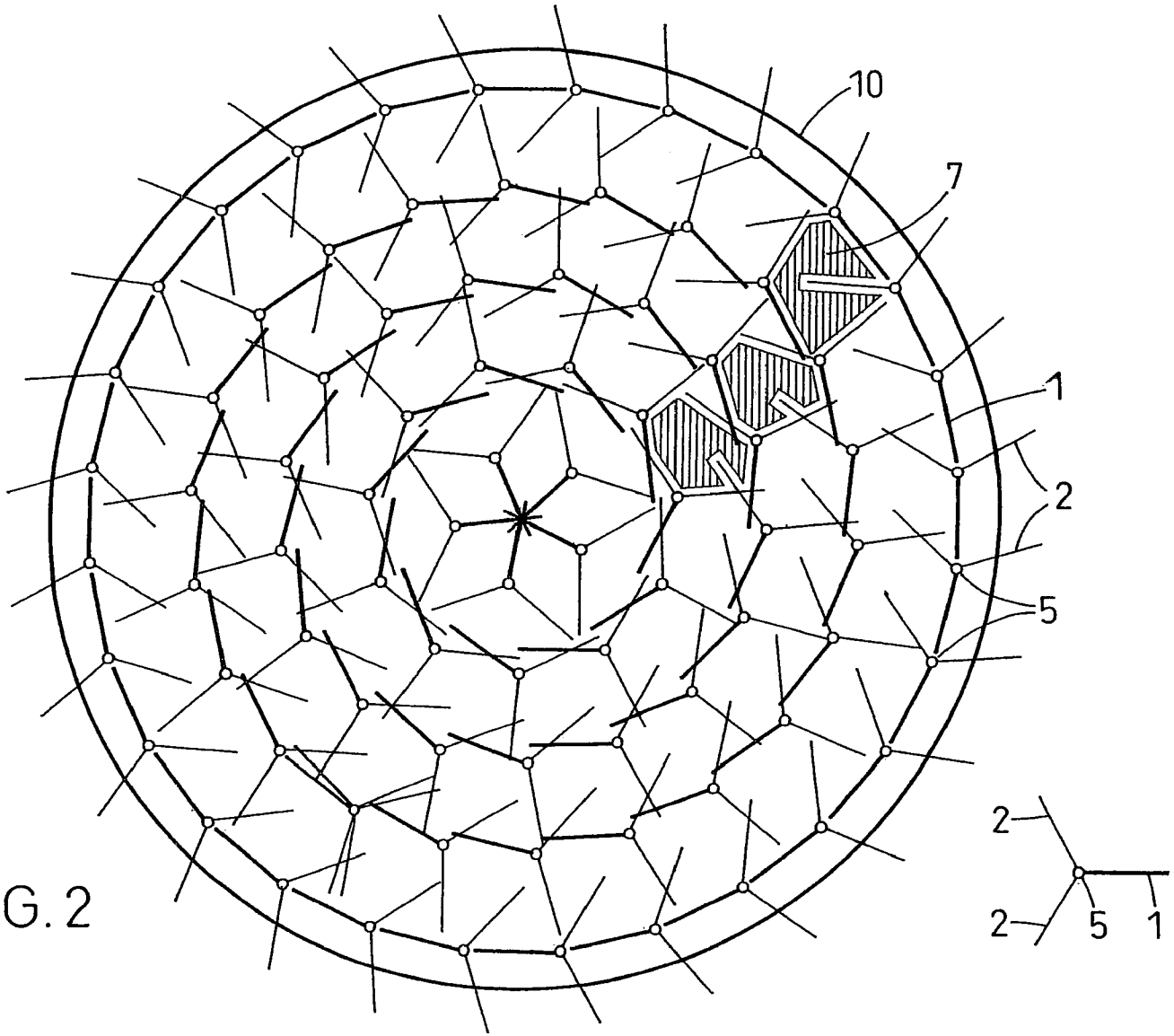
FIG. 2 schematically shows a second arrangement for achieving a flowing field of turbulence.

FIG. 2 shows the same assembly as FIG. 1 but in another form of orientation. With this orientation for achieving the main flow direction the nozzles of each lance are not aligned to the next one but rather to one lance situated downstream. Compared to the arrangement in FIG. 1 a stronger "crossing of jets" takes place without the overriding flow distributing the energy disappearing. The stagnant zones drawn in by way of hatching remain essentially equally large. It thus becomes clear that by way of merely aligning the lances these backwater-like regions may not be intensively processed. One thus needs to distribute a directed transport of the produced turbulences over the whole space to be processed.

Figure 3:
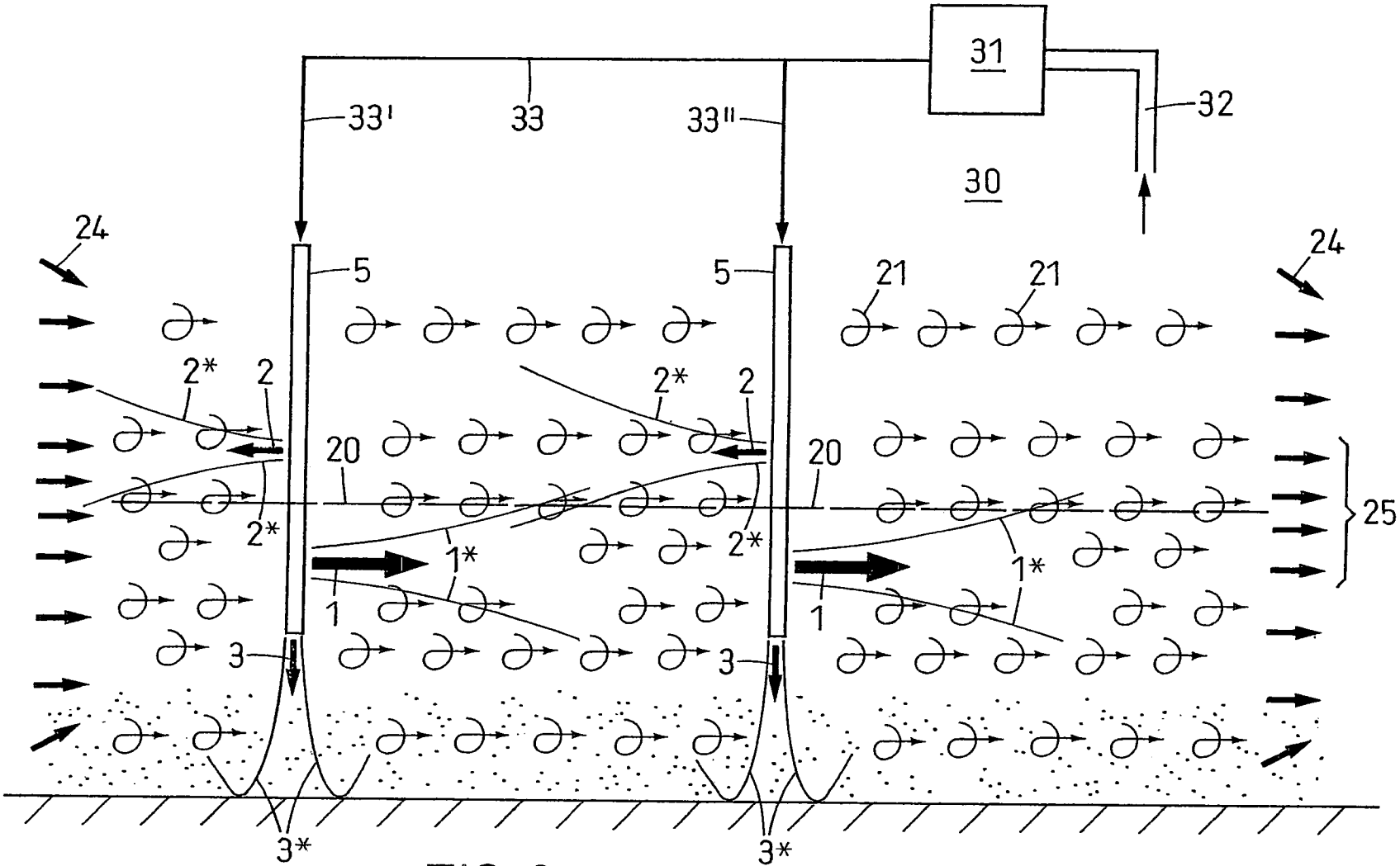
FIG. 3 likewise schematically shows a flowing field of turbulence produced according to the arrangement according to the FIGS. 1 and 2, observed from the side, as well as an arrangement for recirculation of the medium for maintaining the mass in the volume into which the energy is introduced.

FIG. 3 shows the effect of the immersed jets in a perpendicular section to the two FIGS. 1 and 2 discussed above, thus observed from the side. The most intensive local turbulence formation is effected at the shear surfaces of the opposed jet direction, here drawn in as an imagined shear surface 20. Although the immersed jet per se, or its energy finally also dissolves into turbulences due to the resistance of the surrounding medium, the turbulence formation at the macroscopic shear surfaces is considerably stronger. FIG. 3 attempts to show this procedure by picture. The boldly drawn arrows 1 represent jets of a higher through-flow, thus of a larger mass movement, the more thinly drawn arrows 2 represent jets of a lower mass movement, for example only half that of the jets driving the overriding flow. The influence of the immersed jet on its surroundings is illustrated and represented schematically by the envelopes 1*, 2* and 3* as diverging lines at each arrow. Most local turbulences 21 form at the shear surface drawn in with a dashed line 20, and here they are drawn more densely or closer to one another in order to illustrate this. The resulting superimposed flow is represented by flow arrows 24 and by small arrows on the curls representing the turbulences and the compacting is thus represented with the arrows lying closer to one another, grouped with the bracket 25. The figure furthermore shows the axially directed flow exiting at the lower lance shank by arrow 3, whose envelopes 3* reflect on the bottom of the vessel and thus also contribute to the formation of eddies. A single jet without so to say being reinforced by the assembly in this manner would only be lost in the surrounding medium by which means its energy is constantly diluted without being able to be effective as a turbulence generator. This would not fulfil the purpose of the invention. It is the targeted cooperation that produces the desired effect.

It is then shown that the influence of the jet with the larger mass movement and the influence of the opposing jet with the low mass movement, for example half of this, in a limited space produces a strong shear on account of which local turbulences arise, that is to say local regions are formed which one may describe as turbulence generators, said turbulences being carried further with the flow effected by the jets with the larger mass movement and being distributed over regions in which no strong turbulences arise. In place of a nozzle with a larger cross section and more mass movement capability one may also use two or three nozzles with the same cross section as the nozzles effecting the opposing movement, for example $3\times100$ $mm^2$ in the main flow direction and $2\times100$ $mm^2$ in the counter-flow direction. It is essential that a transport and, thus, a distribution of the locally produced turbulences is effected.

While with the figure it was mainly the formation of turbulence that was discussed, FIG. 3 in a likewise schematic representation shows the recirculation of the material to be thoroughly mixed. In a layer 30 above the zone in which the formation and distribution of the turbulence takes place, by way of a pump 31 via a suction union 32 one removes so much as is fed into the micro-swirl bed via feed conduits 33 or 33' and 33", by which means the demanded continuity or retention of the masses is fulfilled. The flow conditions in the upper-lying medium are much less intensive. Indeed according to the arrangement of the suction stations with regard to the flowing turbulent layer they effect a certain shielding of the main flow to the top. In other words, the effect propagated upwards by the fluid friction, specifically the joining of the flow direction, is disturbed or damped. The vertical effects are, however further encouraged by the heating of the medium by way of the internal friction, by which means a convection upwards arises. On the whole all these phenomena contribute to thorough mixing, but not as intensively as the formation of turbulence generators and the transport the local turbulences over the desired volume, which is determined by the height and the arrangement of the nozzles in the medium.

If it is merely the question of thorough mixing of a fluid, then the suctioning for the recirculation may also be effected at locations close to or in the turbulence bed or micro-swirl bed. It is however to be noted that the suctioned turbulent medium has calmed down on the way to the pump.

Figure 4:
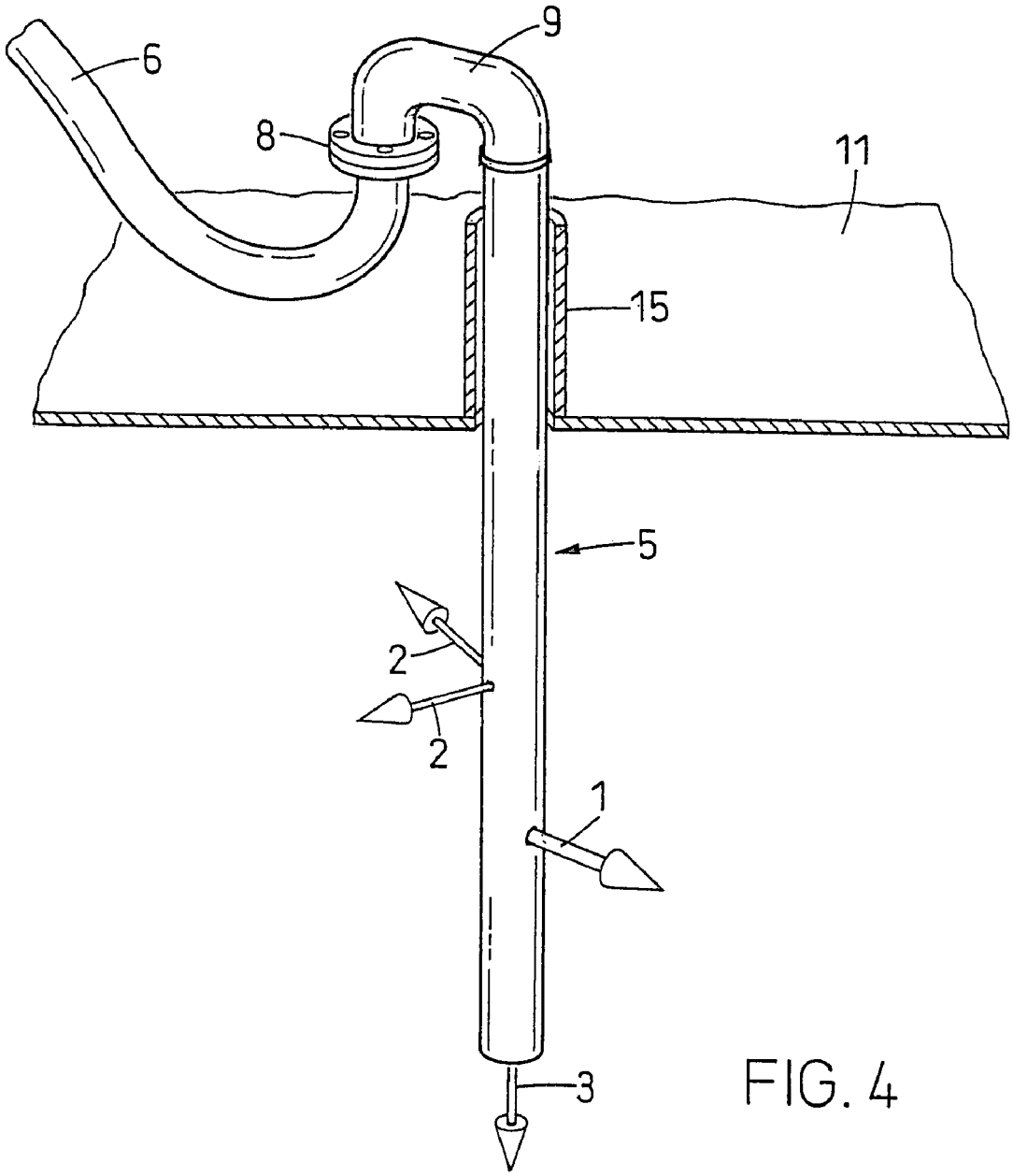
FIG. 4 shows the core piece of the device, a lance which here is shown schematically, with nozzles for the formation of the main flow and for forming local turbulences together with the other equally designed lances in an assembly for carrying out the method for distributing the turbulences.

The device for carrying out the method consists of an assembly of a plurality of cooperating lances, thus of an arrangement effecting a flow system, and an example of such is shown in FIG. 4, with nozzles of various through-flow quantities or also of the same through-flow quantities with correspondingly more nozzles which are orientated to one another according to the method. The nozzles may also have orientations which only effect a component opposed to or in the main direction. One recognizes the lance shank of the lance 5 with a nozzle for the jet 1 generating the main flow and the nozzles for the jets 2 forming opposing components with respect to the flow. At the lower end of the lance in FIG. 4 there is arranged the nozzle for the fourth jet 3. A diffuser 9 is arranged at the upper end which here is drawn schematically as an elbow bend, and to this via a flange there is attached a feed flexible tubing 6 for the fluid as a hose connection. The lance is introduced through a casing 15 in the lid 11 of the container 10, which is shown in section, and is orientated to the multitude of other lances that are arranged in the same lid, and is fixed.

Such lances are very efficient in manufacture, assembly and in operation. They are preferably hollow bodies without parts that move during operation, simple tubes with nozzles, which at the one side are supplied with the medium and escape at the other side through the nozzles. A preferred embodiment form of the lance comprises a "neutral" nozzle arranged in its axis, a nozzle arranged transversely to the longitudinal axis of the lance for the main flow direction, thus a nozzle with a large cross section and two further nozzles at a distance or spacing to this towards the side of supply and transverse to the longitudinal axis of the lance, as FIG. 4 shows, to the nozzle for the main flow direction, wherein the active cross section of both nozzles together is at least a third smaller than the cross section of the nozzle for the main flow direction. The main flow may also be accomplished with several nozzles. It is merely a question of the total cross section in the main direction being larger than in the opposing direction, which also concerns any direction component.

Figure 5:
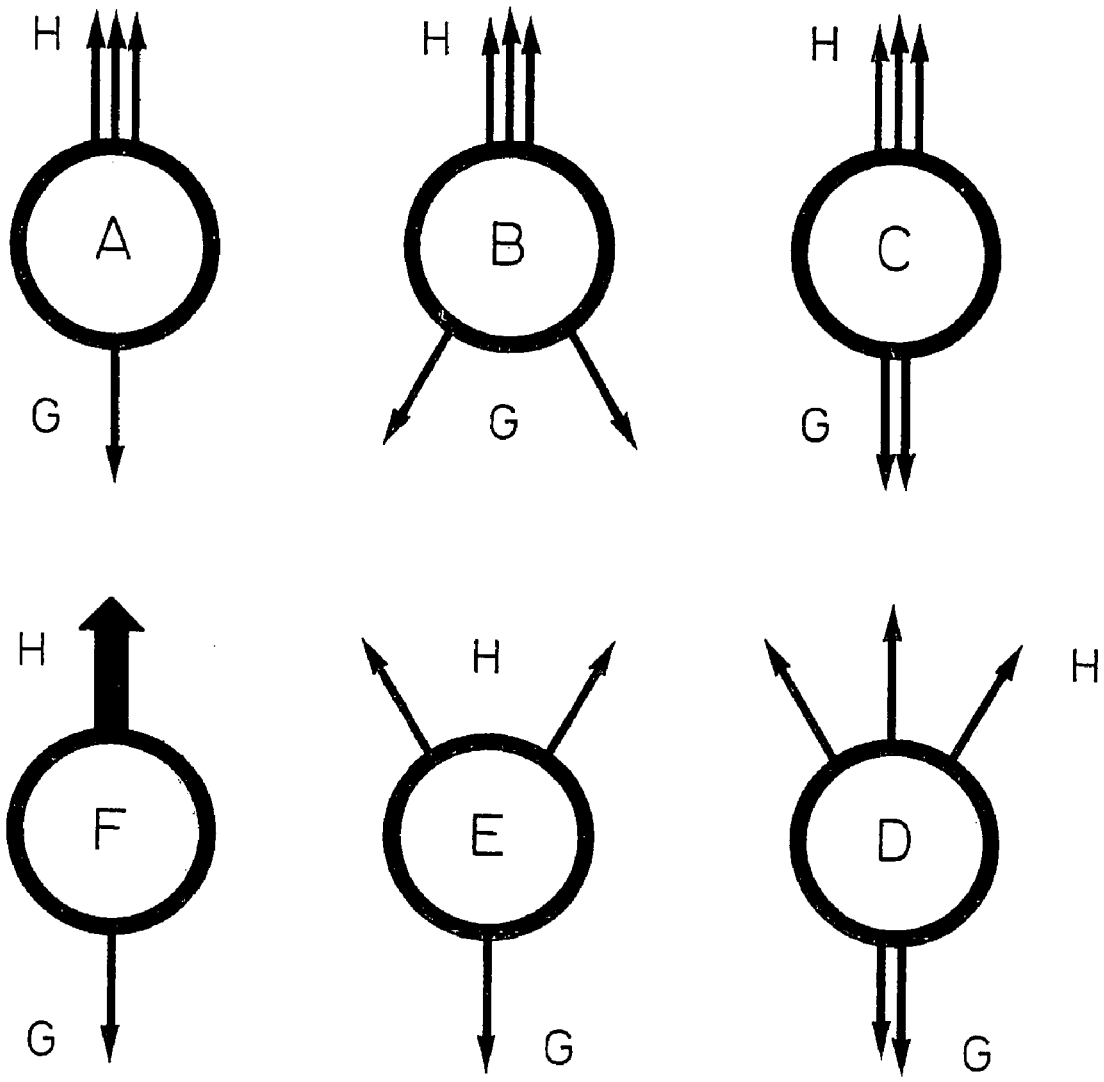
FIG. 5 schematically shows in the form of pictograms some possible arrangements of the nozzles on the lances for producing a flowing field of turbulence.

FIG. 5 in the form of 6 pictograms A, B, C, D, E, F shows some arrangements of nozzles on a lance, wherein the nozzles although being drawn next to one another are arranged in different planes or along the lance shank. The nozzles for the main flow direction or their active cross section in the picture are drawn upwards and indicated at H, the nozzles for the counter direction flow or their active cross section is indicated at G. Each of these planes (see also FIG. 4) may comprise one or more nozzles. Here merely the principle is shown.

Pictogram A for example shows 3 nozzles each with 100 $mm^2$ cross section and a nozzle in the counter direction with 100 $mm^2$ for example arranged in the plane of the uppermost main flow direction nozzle. Pictogram B shows, similar to FIG. 5 a total cross section in the main flow direction and ⅔ the total flow cross section in each case at a 120 degree angle which produces a component in the counter direction which is the same as with the pictogram A, wherein another turbulence formation arises. Pictogram C shows a ratio of 3:2, thus ⅔ of the effect in the counter direction. Pictogram D shows a variant in which purely numerically no essentially larger flow is to arise in the main flow direction, but despite this there forms a slight flow opposed to the counter flow. Pictogram E shows the same, wherein it is clear that these two variants are not very process-intensive. Pictogram F for the sake of completeness and as discussed initially shows that instead of 2 or 3 nozzles each with a cross section of for example 100 $mm^2$ in the main flow direction one may use a nozzle with 200 $mm^2$ or even 300 $mm^2$. This is important inasmuch as larger mass flows as a rule display a larger effect. Thus, in each case one needs to weigh up whether more individual jets with a smaller mass flow, thus a smaller cross section, or less individual jets with a larger cross section are to be applied.

This method and the device may thus be used for processes which require requiring an intimate thorough mixing of large volumes. These may, as initially cited be crude oil tanks of any size, thus up to 100 m diameter or more or chemical reactors of a few meters diameter of large mixing tanks, or the like. With reactors the lid would comprise a suitable quantity of injectors that are dimensioned and orientated to one another according to the invention, which may be easily exchanged and may be well cleaned. The cleaning of the injectors is no problem since it is essentially the case of tubes. In applications where contamination is significant, the injector may be designed such that, where possible, it has no undercuts in which substances may settle. The cleaning procedure should allow the substances of the previous processing to be completely washed away by way of the through-flow in the injector and the intensive mixing.

The invention claimed is:

1. A method for distributing hydrokinetic energy in large volumes of fluids, in which a multitude of local turbulences are produced in the fluid, comprising the steps of:

directing a plurality of equally directed immersed jets in an environment of at least one first plane in a first direction;

directing a plurality of equally directed immersed jets in an environment of at least one second or third plane lying above or below the first plane in a second direction, said second direction being counter to said first direction and said planes being spaced from one another such that, between counter directed jets, there is formed a turbulence-forming shear surface and conveying the thus formed turbulences in a common direction, wherein the immersed jets in the environment of one of the planes have a larger through-flow than a through-flow of the immersed jets in the environment of the at least one second or third plane for achieving an overriding flow, and thereby transporting the formed turbulences the common direction by the overriding flow.

2. The method according to claim 1, wherein a plurality of environments of planes with immersed jets and turbulence-forming shear surfaces formed between the planes is produced, wherein at least one environment of a plane with immersed jets has a greater through-flow for achieving an overriding flow than the planes with the jets of all other environments of planes together, in order to transport the formed multitude of turbulences by the overriding flow in the common direction.

3. The method according to claim 1, wherein a plurality of environments of planes with immersed jets and turbulence-forming shear surfaces formed between the planes is produced, wherein the jets of the environment of the at least one first or at least one plane are directed in the counter direction to components of the jets of the environments of all other planes, and wherein the jets of the environment of the at least one first or at least one plane have a larger through-flow than the components of the opposing jets, in order to transport the formed turbulences in the common direction.

4. The method according to claim 1, wherein a plurality of environments of planes with immersed jets and turbulence-producing shear surfaces formed between the planes is produced, wherein jets of a first portion of the plurality of environments of planes are orientated in the one direction and jets of a second portion of the multitude of environments of planes are orientated in an opposing direction, and the jets of one of said first and second portions has the larger through-flow than the jets of the other of said first and second portions.

5. The method according to claim 1, wherein the fluid for achieving the immersed jets of various through-flow quantities is taken from the same medium.

6. The method according to claim 5, wherein the fluid for achieving the immersed jets of various through-flow quantities is taken from the same medium but outside or above a flowing turbulence bed.

7. The method according to claim 5, wherein the fluid, for achieving the immersed jets of various through-flow quantities is taken from the same medium but within a flowing turbulence bed.

8. The method according to claim 1, wherein the overriding flow is a closed flow.

9. A device for carrying out the method according to claim 1, comprising a plurality of tubular bodies with a fluid inlet on one side and with an arrangement of nozzles for a fluid outlet on an other side, at least one nozzle on each body has a cross section that is larger than a cross-section of other nozzles pointing in another direction, a sum of the cross sections of said other nozzles being smaller than that of the at least one nozzle with the larger cross section, wherein the bodies are arranged such that the at least one nozzle with the larger cross section have the same orientation.

10. A tubular body for use in the device according to claim 9, comprising the nozzles with different cross sections that are arranged such that said one nozzle with the largest cross section points in one direction, and the other nozzles point in another direction.

11. A tubular body for use in the device according to claim 9, comprising nozzles with the same or different cross sections that are arranged such that in at least one direction the nozzles have a larger effective cross section than the effective cross section of all other nozzles that do not point in the at least one direction.

12. A device for carrying out the method according to claim 1, comprising a plurality of tubular bodies with a fluid inlet on one side and with an arrangement of nozzles for a fluid outlet on another side, with nozzles pointing in one common direction and nozzles pointing in other directions, wherein the nozzles pointing in other directions have an angle of 120° between said other directions, and wherein either the nozzles with the common direction have a larger summed effective cross section that the nozzles pointing in other directions or the nozzles pointing in other directions have a larger summed effective cross section than the nozzles with the common direction.

13. A tubular body for use in the device according to claim 12, comprising the nozzles and wherein the nozzles all have a same cross section and are arranged such that at least two nozzles point in one common direction and two nozzles point in other directions, these two nozzles pointing in other directions having an angle of 120° in between their directions, wherein the at least two nozzles pointing in one common direction have a larger summed cross section than the effective cross section of the two nozzles pointing in other directions.

14. A tubular body for use in the device according to claim 12, comprising the nozzles and wherein the nozzles all have a same cross section and are arranged such that at least one nozzle points in one direction and at least two nozzles point in other directions, wherein the two nozzles that point in other directions have an angle of 120° in between their directions and have a larger common effective cross section than the cross section of the one nozzle pointing in one direction.

15. A method for distributing hydrokinetic energy in a large volume of fluid and sediment within a crude oil tank, in which a multitude of local turbulences are produced in the fluid, comprising the steps of:

directing a plurality of equally directed immersed jets in an environment of at least one first plane in a first direction;

directing a plurality of equally directed immersed jets in an environment of at least one second or third plane lying above or below the first plane in a second direction, said second direction being counter to said first direction and said planes being spaced form one another such that, between counter directed jets, there is formed a turbulence-forming shear surface and conveying the thus formed turbulences in a common direction, wherein the immersed jets in the environment of one of the planes have a larger through-flow than a through-flow of the immersed jets in the environment of the at least one second or third plane for achieving an overriding flow, and thereby transporting the formed turbulences the common direction by the overriding flow, and whereby the sediment within the crude oil tank is liquefied.

16. A method for distributing hydrokinetic energy in a large volume of fluid material within a chemical reactor, in which a multitude of local turbulences are produced in the fluid material, comprising the steps of:

directing a plurality of equally directed immersed jets in an environment of at least one first plane in a first direction;

directing a plurality of equally directed immersed jets in an environment of at least one second or third plane lying above or below the first plane in a second direction, said second direction being counter to said first direction and said planes being spaced form one another such that, between counter directed jets, there is formed a turbulence-forming shear surface and conveying the thus formed turbulences in a common direction, wherein the immersed jets in the environment of one of the planes have a larger through-flow than a through-flow of the immersed jets in the environment of the at least one second or third plane for achieving an overriding flow, and thereby transporting the formed turbulences the common direction by the overriding flow, and whereby the fluid material is intensely mixed or processed.

* * * * *